US009904219B2

(12) United States Patent
Takagi

(10) Patent No.: US 9,904,219 B2
(45) Date of Patent: Feb. 27, 2018

(54) FIXING DEVICE AND FIXING TEMPERATURE CONTROL METHOD OF FIXING DEVICE

(71) Applicant: KABUSHIKI KAISHA TOSHIBA, Minato-ku, Tokyo (JP)

(72) Inventor: Osamu Takagi, Tokyo (JP)

(73) Assignees: TOSHIBA TEC KABUSHIKI KAISHA, Tokyo (JP); KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 15/458,213

(22) Filed: Mar. 14, 2017

(65) Prior Publication Data

US 2017/0185017 A1 Jun. 29, 2017

Related U.S. Application Data

(63) Continuation of application No. 15/186,780, filed on Jun. 20, 2016, now Pat. No. 9,720,360, which is a (Continued)

(30) Foreign Application Priority Data

May 19, 2014 (JP) ..... 2014-103770

(51) Int. Cl.
*G03G 15/20* (2006.01)

(52) U.S. Cl.
CPC ..... *G03G 15/2039* (2013.01); *G03G 15/2042* (2013.01); *G03G 15/2046* (2013.01); *G03G 15/2053* (2013.01); *G03G 15/2082* (2013.01)

(58) Field of Classification Search
CPC ..... G03G 15/2039; G03G 15/2042; G03G 15/2046; G03G 15/2082; G03G 15/2053; G03G 2215/2022
See application file for complete search history.

(56) References Cited

U.S. PATENT DOCUMENTS 5,495,275 A 2/1996 Martinengo
7,424,260 B2 9/2008 Nishiyama et al.
(Continued)

FOREIGN PATENT DOCUMENTS

JP 05-333746 12/1993
JP 2005-339840 12/2005
JP 2012-252190 12/2012

OTHER PUBLICATIONS

Non-Final Office Action for U.S. Appl. No. 14/715,832 dated Dec. 9, 2015, 23 pages.
(Continued)

*Primary Examiner* — Rodney Bonnette
(74) *Attorney, Agent, or Firm* — Amin, Turocy & Watson LLP; Gregory Turocy

(57) ABSTRACT

According to one embodiment, a fixing device includes determination means for determining the size of an image forming area of a medium, heating means for including an endless rotating body, plural heat-generating members which are formed in a perpendicular direction to a transporting direction, inclined by a predetermined angle, and divided by a predetermined length, and are disposed so as to come into contact with an inner side of the rotating body, and a switching unit which switches individual conduction, and heats the medium, pressing means for forming a nip by performing pressing and contact at a position of the plural heat-generating members, and nipping and carrying the medium in the transporting direction along with the heating means, and heating control means for controlling the switching unit to select and conduct heat-generating members and controlling the heating means to heat the medium.

18 Claims, 10 Drawing Sheets

Related U.S. Application Data continuation of application No. 14/715,832, filed on May 19, 2015, now Pat. No. 9,411,276.

(56) References Cited

U.S. PATENT DOCUMENTS

| | | | |
|---|---|---|---|
| 7,512,370 | B2 | 3/2009 | Shimizu et al. |
| 2012/0121306 | A1 | 5/2012 | Shimura et al. |
| 2014/0076878 | A1 | 3/2014 | Shimura |
| 2014/0219696 | A1 | 8/2014 | Fujimoto et al. |
| 2015/0110530 | A1 | 4/2015 | Uehara et al. |
| 2015/0331372 | A1 | 11/2015 | Takagi |
| 2015/0331376 | A1 | 11/2015 | Shimmura et al. |

OTHER PUBLICATIONS

Non-Final Office Action for U.S. Appl. No. 15/186,780 dated Sep. 29, 2016, 33 pages.

Japanese Office Action for Japanese Patent Application No. 2014-103770 dated Oct. 24, 2017.

FIXING DEVICE AND FIXING TEMPERATURE CONTROL METHOD OF FIXING DEVICE

CROSS-REFERENCE TO RELATED APPLICATIONS

This application is a Continuation of application Ser. No. 15/186,780 filed on Jun. 20, 2016, which is a Continuation of application Ser. No. 14/715,832 filed on May 19, 2015, the entire contents of both of which are incorporated herein by reference.

This application is based upon and claims the benefit of priority from Japanese Patent Application No. 2014-103770, filed May 19, 2014, the entire contents of which are incorporated herein by reference.

FIELD

Embodiments described herein relate generally to a fixing device and a fixing temperature control method of the fixing device.

BACKGROUND

A lamp which is representatively a halogen lamp and generates infrared rays, or a method of performing heating with Joule's heating by using electromagnetic induction is put into practical use as a heat source of a fixing device which is mounted in an image forming apparatus.

Generally, the fixing device is configured by a pair consisting of a heating roller (or a fixation belt crossing over a plurality of rollers) and a pressing roller. However, it is required that the heat capacity of components is reduced as much as possible and heating is performed focused on a heating area, in order to maximize the thermal efficiency of the fixing device. In this regard, in the above-described heating method, the width of a heating area is wide and thus it is difficult to apply heat energy which is dispersed in a wide range to only a nip portion intensively and it is difficult to optimize the thermal efficiency.

In a fixing device for electrophotography, when heating unevenness occurs in a perpendicular direction to a paper transporting direction, the unevenness has an influence on fixing quality. Particularly, when color printing is performed, a difference in color formation or luster may occur.

In a fixing device having extremely reduced heat capacity, the temperature at a portion through which paper does not pass is extremely increased. Thus, a problem such as speed irregularity may occur due to warpage of a heater, deterioration of a belt, and expansion of a transporting roller. In view of energy saving, heating the portion through which the paper does not pass is not preferable. In view of environmental correspondence, intensively heating only a portion through which paper passes causes an important technical problem.

An example of the related art includes JP-A-2000-243537.

DETAILED DESCRIPTION

Considering the above-described problems, an object of exemplary embodiments is to provide a fixing device and a fixing temperature control method of the fixing device which enables a paper passing area to be stably heated in a concentrated manner and in which it is possible to obtain improvement of fixing quality and energy saving.

In general, according to one embodiment, a fixing device includes determination means, heating means, pressing means, and heating control means. The determination means determines the size of a medium on which a toner image is formed. The heating means includes an endless rotating body, a plurality of heat-generating members, and a switching unit, and heats the medium. The plurality of heat-generating members are formed in a perpendicular direction to a transporting direction of the medium, inclined from the transporting direction to a direction of a predetermined angle, and divided by a predetermined length, and are disposed so as to come into contact with an inner side of the rotating body. The switching unit switches individual conduction of these heat-generating members. The pressing means forms a nip by performing pressing and contact at a position of the plurality of heat-generating members in the heating means, and nips and carries the medium in the transporting direction along with the heating means. The heating control means controls the switching unit to select and conduct heat-generating members corresponding to a position through which the medium passes, among the plurality of heat-generating members and controls the heating means to heat the medium.

Figure 1:
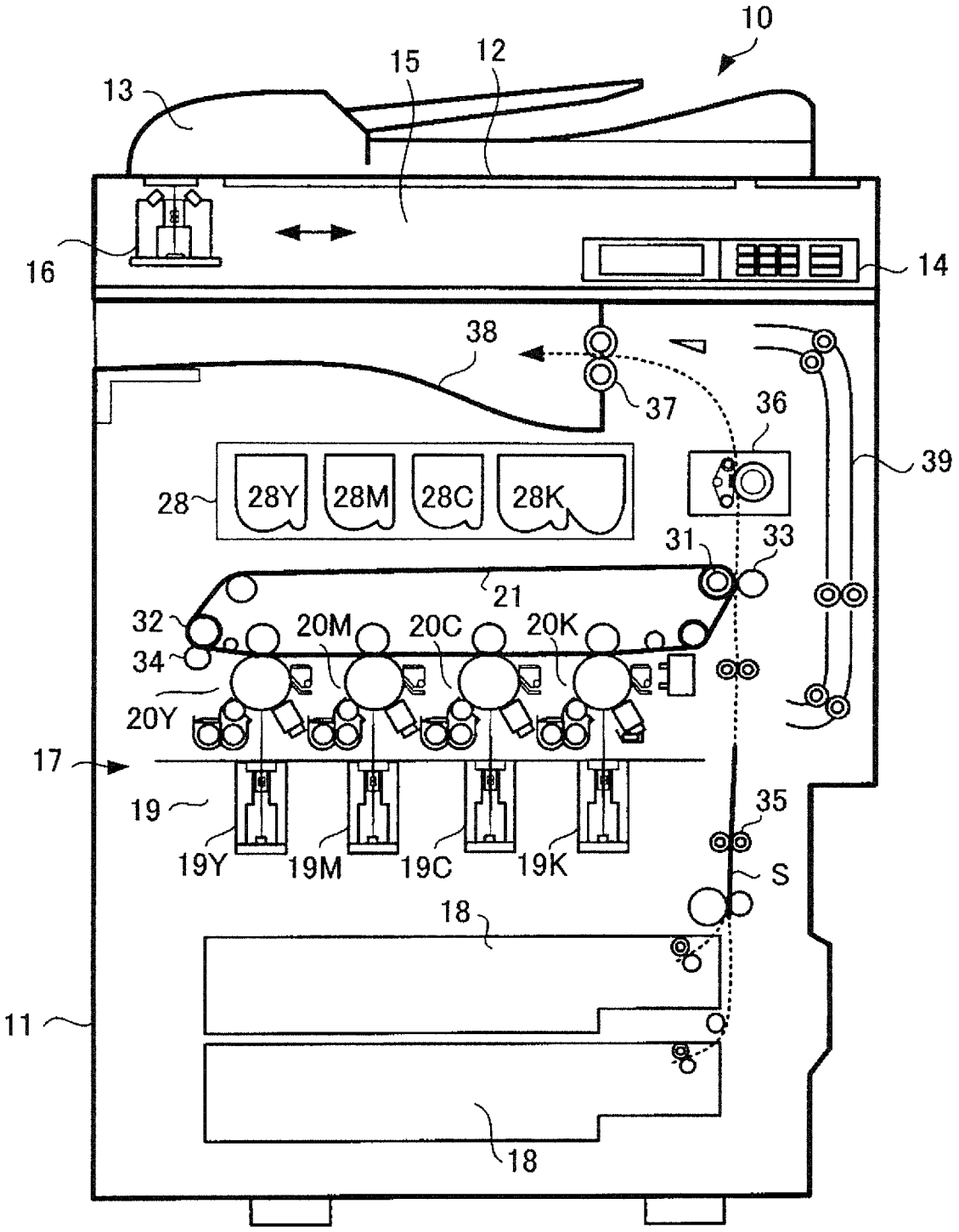
FIG. 1 is a diagram illustrating a configuration example of an image forming apparatus in which a fixing device according to an embodiment is mounted.

FIG. 1 is a diagram illustrating a configuration example of an image forming apparatus in which a fixing device according to Embodiment 1 is mounted. In FIG. 1, the image forming apparatus 10 is, for example, a combined machine such as a multi-function peripheral (MFP), a printer, and a copier. In the following descriptions, an MFP is used as an example.

There is a manuscript stand 12 of transparent glass on an upper portion of a main body 11 in the MFP 10. An automatic document feeder (ADF) 13 is provided on the manuscript stand 12 to be freely opened and closed. An operation panel 14 is provided on the upper portion of the main body 11. The operation panel 14 includes various keys and a touch panel type display unit.

A scanner unit 15 which is a reading device is provided under the ADF 13 in the main body 11. The scanner unit 15 reads an original document which is fed by the ADF 13 or an original document which is placed on the manuscript stand, and generates image data. Thus, the scanner unit 15 includes a contact type image sensor 16 (simply referred to as an image sensor below). The image sensor 16 is disposed in a main scanning direction (depth direction in FIG. 1).

The image sensor 16 reads an original document image line by line while moving along the manuscript stand 12 when reading an image of an original document which is placed on the manuscript stand 12. This operation is performed on the entire size of the original document and thus reading the original document for one page is performed. When reading an image of an original document which is fed by the ADF 13, the image sensor 16 has a fixed position (illustrated position).

A printer unit 17 is included in the center portion of the main body 11. A plurality of paper cassettes 18 which are for storing various sizes of paper P are included in a lower portion of the main body 11. The printer unit 17 includes a photoconductive drum and a scanning head 19 which includes an LED as an exposing device. The printer unit 17 scans a photoconductor with light beams from the scanning head 19 and generates an image.

The printer unit 17 processes image data which is read by the scanner unit 15, or image data which is created by a personal computer or the like, and forms an image on paper. The printer unit 17 is, for example, a tandem type color laser printer and includes an image forming unit 20Y for yellow (Y), an image forming unit 20M for magenta (M), an image forming unit 20C for cyan (C), and an image forming unit 20K for black (K). The image forming units 20Y, 20M, 20C, and 20K are disposed parallel on a lower side of an intermediate transfer belt 21 along a downstream side from an upstream side. The scanning head 19 also includes a plurality of scanning heads 19Y, 19M, 19C, and 19K respectively corresponding to the image forming units 20Y, 20M, 20C, and 20K.

Figure 2:
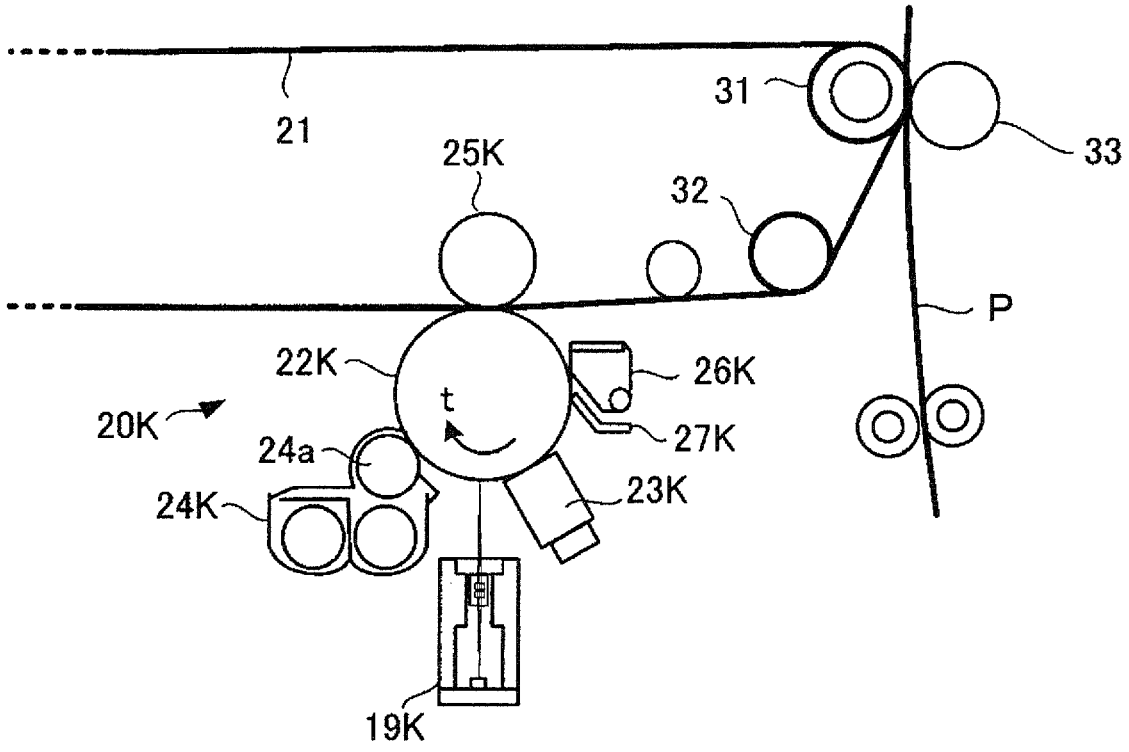
FIG. 2 is a configuration diagram illustrating a partially enlarged portion of the image forming unit according to the embodiment.

FIG. 2 is a configuration diagram illustrating the image forming unit 20K which is enlarged among the image forming units 20Y, 20M, 20C, and 20K. Since the image forming units 20Y, 20M, 20C, and 20K have the same configuration in the following descriptions, descriptions will be made by using the image forming unit 20K as an example.

The image forming unit 20K includes a photoconductive drum 22K which is an image carrying body. A charger 23K, a developing device 24K, a primary transfer roller (transferring device) 25K, a cleaner 26K, a blade 27K, and the like are disposed around the photoconductive drum 22K along a rotation direction t. An exposure position of the photoconductive drum 22K is irradiated with light from the scanning head 19K and thus an electrostatic latent image is formed on the photoconductive drum 22K.

The charger 23K of the image forming unit 20K causes a surface of the photoconductive drum 22K to be uniformly charged. The developing device 24K supplies a two-component developer which contains toner of black and carriers to the photoconductive drum 22K by using a developing roller 24*a* to which developing bias is applied, and develops the electrostatic latent image. The cleaner 26K removes a residual toner on a surface of the photoconductive drum 22K by using the blade 27K.

As illustrated in FIG. 1, a toner cartridge 28 for supplying a toner to each of the developing devices 24Y to 24K is provided over the image forming units 20Y to 20K. The toner cartridge 28 includes toner cartridges for yellow (Y), magenta (M), cyan (C), and black (K).

The intermediate transfer belt 21 moves circularly. The intermediate transfer belt 21 crosses over a driving roller 31 and a driven roller 32. The intermediate transfer belt 21 faces and comes into contact with the photoconductive drums 22Y to 22K. A primary transfer voltage is applied to a position of the intermediate transfer belt 21 facing the photoconductive drum 22K by the primary transfer roller 25K, and a toner image on the photoconductive drum 22K is primarily transferred to the intermediate transfer belt 21.

A secondary transfer roller 33 is disposed to face the driving roller 31 over which the intermediate transfer belt 21 crosses. When paper P passes through between the driving roller 31 and the secondary transfer roller 33, a secondary transfer voltage is applied to the paper P by the secondary transfer roller 33. Thus, the toner image on the intermediate transfer belt 21 is secondarily transferred to the paper P. A belt cleaner 34 is provided in the vicinity of the driven roller 32 of the intermediate transfer belt 21.

As illustrated in FIG. 1, a feeding roller 35 for transporting paper P which is taken out from the paper cassette 18 is provided in the middle of a path from the paper cassette 18 to the secondary transfer roller 33. A fixing device 36 is provided on a downstream of the secondary transfer roller 33. A transporting roller 37 is provided on a downstream of the fixing device 36. The transporting roller 37 discharges paper P to a paper discharge unit 38. A reverse transporting path 39 is provided on a downstream of the fixing device 36. The reverse transporting path 39 is for causing paper P to be reversed and introducing the reversed paper P in a direction of the secondary transfer roller 33. Thus, the reverse transporting path 39 is used when double-sided printing is performed. FIGS. 1 and 2 illustrate an example of the embodiment. A structure of the image forming apparatus part except for the fixing device 36 is not limited thereto and a structure of a known electrophotographic type image forming apparatus may be used.

Figure 3:
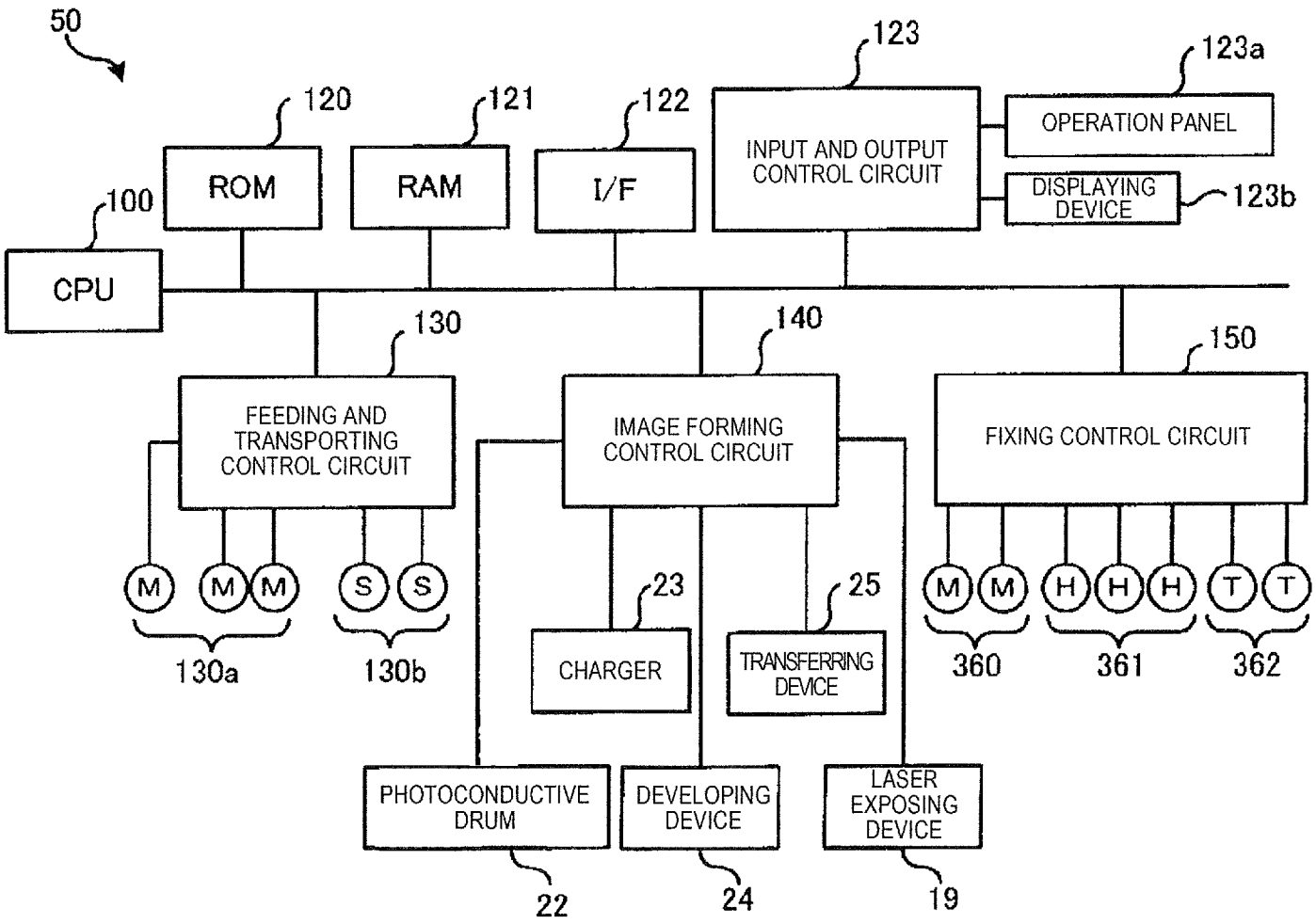
FIG. 3 is a block diagram illustrating a configuration example of a control system in an MFP according to the embodiment.

FIG. 3 is a block diagram illustrating a configuration example of a control system 50 of the MFP 10 according to Embodiment 1. The control system 50 includes a CPU 100 for controlling the overall of the MFP 10, a read only memory (ROM) 120, a random access memory (RAM) 121, an interface (I/F) 122, an input and output control circuit 123, a feeding and transporting control circuit 130, an image forming control circuit 140, and a fixing control circuit 150, for example.

The CPU 100 implements processing functions for image forming by executing a program which is stored in the ROM 120 or the RAM 121. The ROM 120 stores a control program, control data, and the like for causing basic operations in image forming processing to be performed. The RAM 121 is a working memory. The ROM 120 (or the RAM 121) stores, for example, a control program for the image forming unit 20 or the fixing device 36 and various types of control data which are used by the control program. In this embodiment, a specific example of the control data includes a correspondence relationship of a paper size and the heat-generating member to be conducted, or a correspondence relationship of a basis weight of a paper and values of a surface temperature of the heat-generating member and an outdoor air temperature, and the heat-generating member which is to be conducted, and the like. The basis weight and values may be detected by various sensors in the MFP 10.

A fixing temperature control program of the fixing device 36 includes determination logic and heating control logic. The determination logic is for determining the size or the basis weight of paper, and values of a surface temperature of the heat-generating member, an outdoor air temperature, and the like based on a detection signal of a sensor in the MFP 10 and the like. The heating control logic is for selecting switching elements of the heat-generating members corresponding to a position through which paper passes and causing the selected heat-generating members to be conducted, and controlling heating in the heating section.

The I/F 122 causes a user terminal and various devices such as a facsimile to communicate with each other. The input and output control circuit 123 controls an operation panel 123*a*, and a displaying device 123*b*. The feeding and transporting control circuit 130 controls a motor group 130*a* which drives the feeding roller 35 or the transporting roller 37 on a transporting path, and the like. The feeding and transporting control circuit 130 controls the motor group 130*a* and the like based on a control signal from the CPU 100 considering a sensing result of various sensors 130*b* in the vicinity of the paper cassette 18 or on the transporting path. The image forming control circuit 140 controls the photoconductive drum 22, a charger 23, the laser exposing device 19, a developing device 24, a transferring device 25 based on a control signal from the CPU 100. The fixing control circuit 150 controls a driving motor 360 of the fixing device 36, a heating member 361, a temperature sensing member 362 such as a thermistor, and the like based on a control signal from the CPU 100. In this embodiment, a control program of the fixing device 36 and control data are stored in a storage device of the MFP 10 and are executed by the CPU 100. However, a computation device and a storage device which are dedicated for the fixing device 36 may be individually provided.

Figure 4:
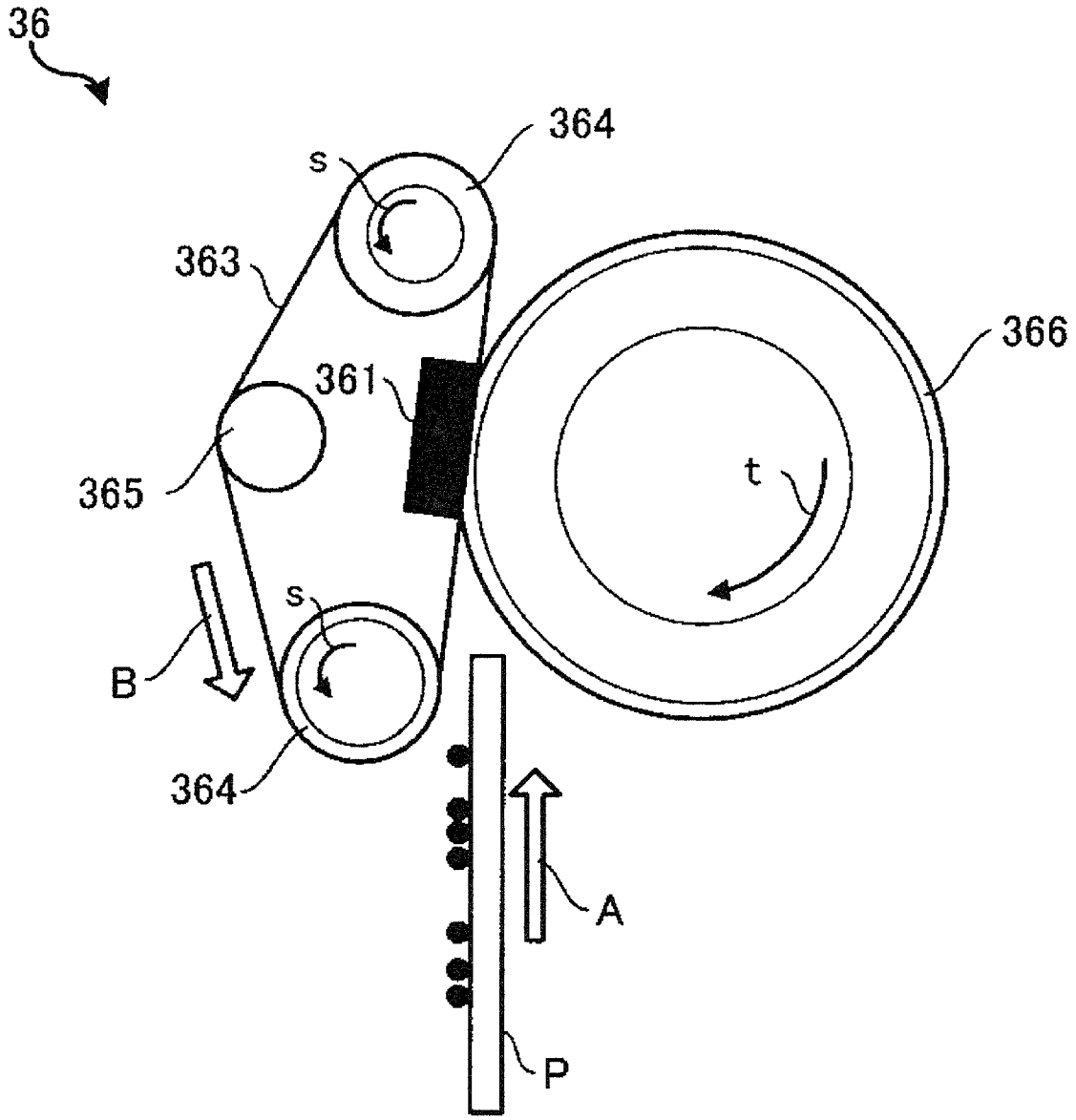
FIG. 4 is a diagram illustrating a configuration example of a fixing device according to the embodiment.

FIG. 4 is a diagram illustrating a configuration example of the fixing device 36. In FIG. 4, the fixing device 36 includes the plate-shaped heating member 361, an endless belt 363, a belt transporting roller 364 for driving the endless belt 363, a tension roller 365 for applying tension to the endless belt 363, and a pressing roller 366. The endless belt 363 has an elastic layer and crosses over a plurality of rollers. An elastic layer is formed on a surface of the pressing roller 366. The heat-generating unit side is brought into contact with the inner side of the endless belt 363 and is pressed in a direction of the pressing roller 366, and thus the heating member 361 forms a fixing nip having a predetermined width at a portion between the heating member 361 and the pressing roller 366. With a configuration in which the heating member 361 forms a nip area and performs heating, responsibility when conduct ion is performed is higher than that when a halogen lamp performs heating.

In the endless belt 363, a silicon rubber layer with a thickness of 200 um is formed on the outer side on an SUS base member with a thickness of 50 um or polyimide which is heat-resistant resin and has a thickness of 70 um, and the outermost circumference is covered with a surface protective layer which is formed of a PFA, and the like, for example. In the pressing roller 366, a silicon sponge layer with a thickness of 5 mm is formed on a surface of an iron rod having 10 mm of ϕ and the outermost circumference is covered with a surface protective layer which is formed of a PFA, and the like, for example.

In the heating member 361, a glazed layer and a heat-generating resistor layer are stacked on a ceramic substrate. In order to emit residual heat to an opposite side and to prevent warpage of the substrate, an aluminium heat sink is bonded. The heat-generating resistor layer is formed of a known material such as $TaSiO_2$, for example, and is divided by a predetermined length and a predetermined number of divisions in the main scanning direction.

A forming method of the heat-generating resistor layer is similar to a known method (for example, creating method of thermal head). An aluminium mask layer is formed on the heat-generating resistor layer. A portion between the heat-generating members which are adjacent to each other is insulated and an aluminium layer is formed with a pattern in which heat-generating resistors (heat-generating member) are exposed in a paper transport direction. Wires are respectively linked from aluminium layers (electrodes) at both ends of the heat-generating member to a switching element of a switching driver IC, and thus conduction of the heat-generating member is controlled. A protective layer is formed on the top portion in order to cover all of the heat-generating resistor, the aluminium layer, the wire, and the like. The protective layer is formed of, for example, $Si_3N_4$ or the like.

Figure 5:
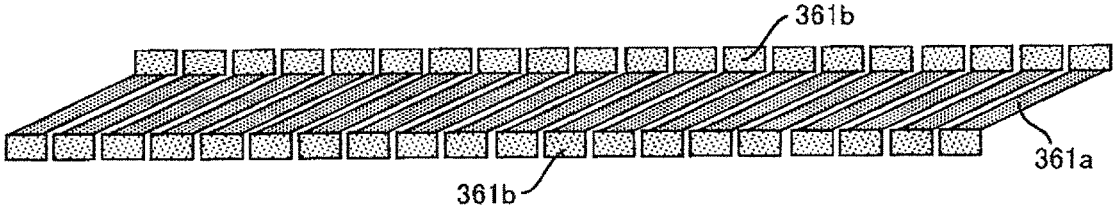
FIG. 5 is an arrangement diagram of heat-generating member groups in the embodiment.
Figure 6:
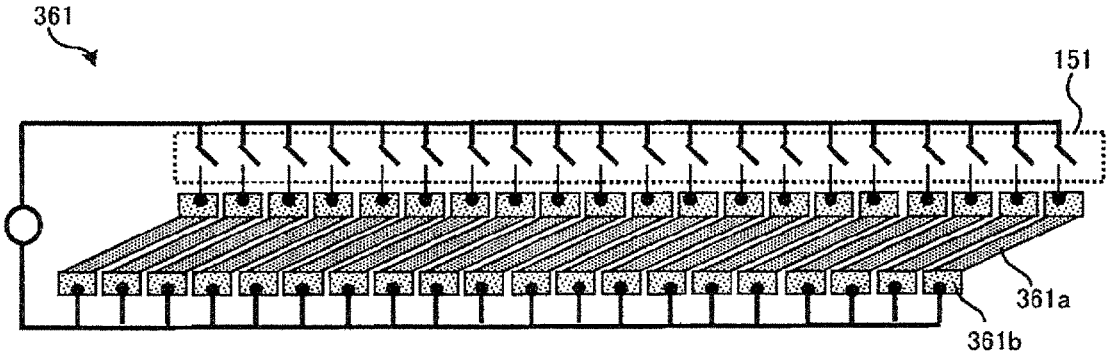
FIG. 6 is a diagram illustrating the heat-generating member groups and driving circuits thereof in the embodiment.

FIG. 5 is an arrangement diagram of the heat-generating member groups in this embodiment. FIG. 6 is a diagram illustrating a connection state of the heat-generating member groups and driving circuits of the heat-generating member groups. As illustrated in FIGS. 5 and 6, a plurality of heat-generating members 361*a* which are obtained by performing division to have a constant width and a predetermined angle (here, about 45 degrees) to the paper transport direction (up and down direction) are disposed on the ceramic substrate to be lined up. Electrodes 361*b* are respectively formed at both end portions of the heat-generating member 361*a* in the paper transport direction. FIG. 6 illustrates that conduction of each of the heat-generating members 361*a* is individually controlled by corresponding driving ICs 151. A specific example of the driving IC 151 which is a switching unit of the heat-generating member 361*a* includes a switching element, an FET, a TRIAC, a switching IC, and the like.

In this embodiment, the heating member 361 is assembled of the parallelogram heat-generating members 361*a* and bottom portions of the heat-generating members 361*a* are arranged on the same line. Thus, an image area of paper straddles and passes through the plurality of heat-generating members 361*a* when fixing processing is performed. For this reason, for example, even though operations are sequentially performed and then heat-generating members are not caused to turn OFF, it is possible to obtain apparently the same effect as an effect of changing an output by thinning out conduction of the heat-generating members at a constant interval in the paper transport direction. This angle is caused to become large in accordance with resolution which is desired to be changed and thus many image areas may be straddled. Thinning out conduction of the heat-generating members enables an output to be adjusted and arbitrarily from 0 W to 1200 W. It is possible to obtain a stepped output and to obtain an arbitrary output which is adjusted by changing a resistance value of the heat-generating resistor at a certain ratio (changing the thickness or a material of a heat-generating layer). If a shape of the above-described mask layer is changed, obtaining the above-described output is enabled. Accordingly, complex changes in manufacturing processing are not required.

Figure 7:
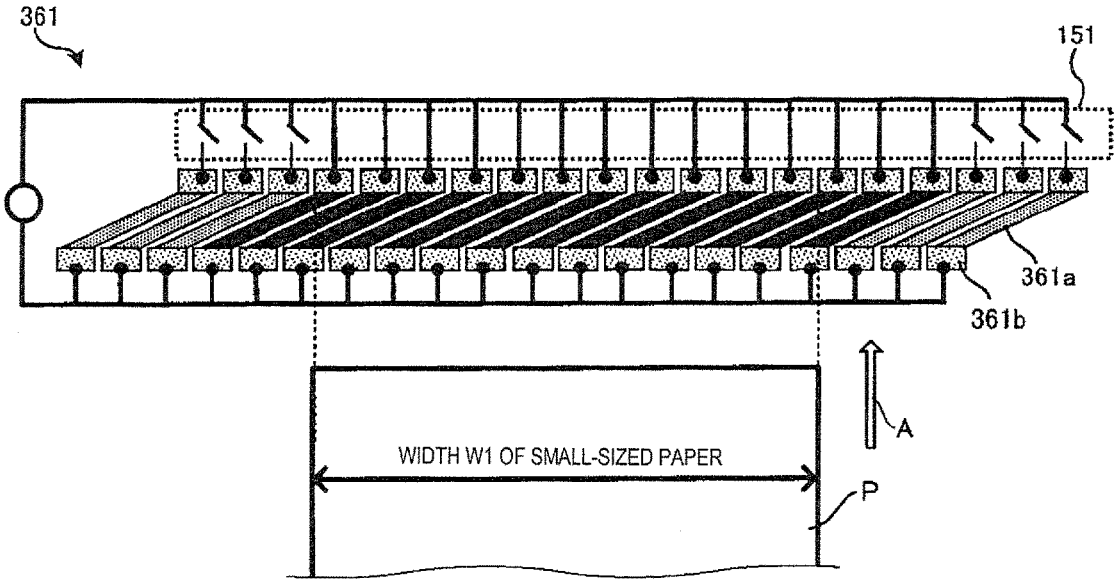
FIG. 7 is a diagram illustrating a connection state of the heat-generating member groups and the driving circuits thereof in the embodiment.

FIG. 7 is a diagram illustrating a connection state of the heat-generating member groups and the driving circuits in this embodiment. FIG. 7 illustrates that when the paper P is transported in the paper transport direction which is indicated by an arrow A, only the heat-generating members 361*a* corresponding to a position through which the paper passes are selectively conducted and heated. That is, only the paper P is intensively heated. In this embodiment, the size of the printing area in the paper P is determined before the paper P is transported into the fixing device 36. As a method of determining the printing area in the paper P, a method of using an analysis result of image data, a method based on printing format information regarding margin setting for the paper P and the like, a method of performing determination based on a detection result of an optical sensor, and the like are included.

Figure 8A:
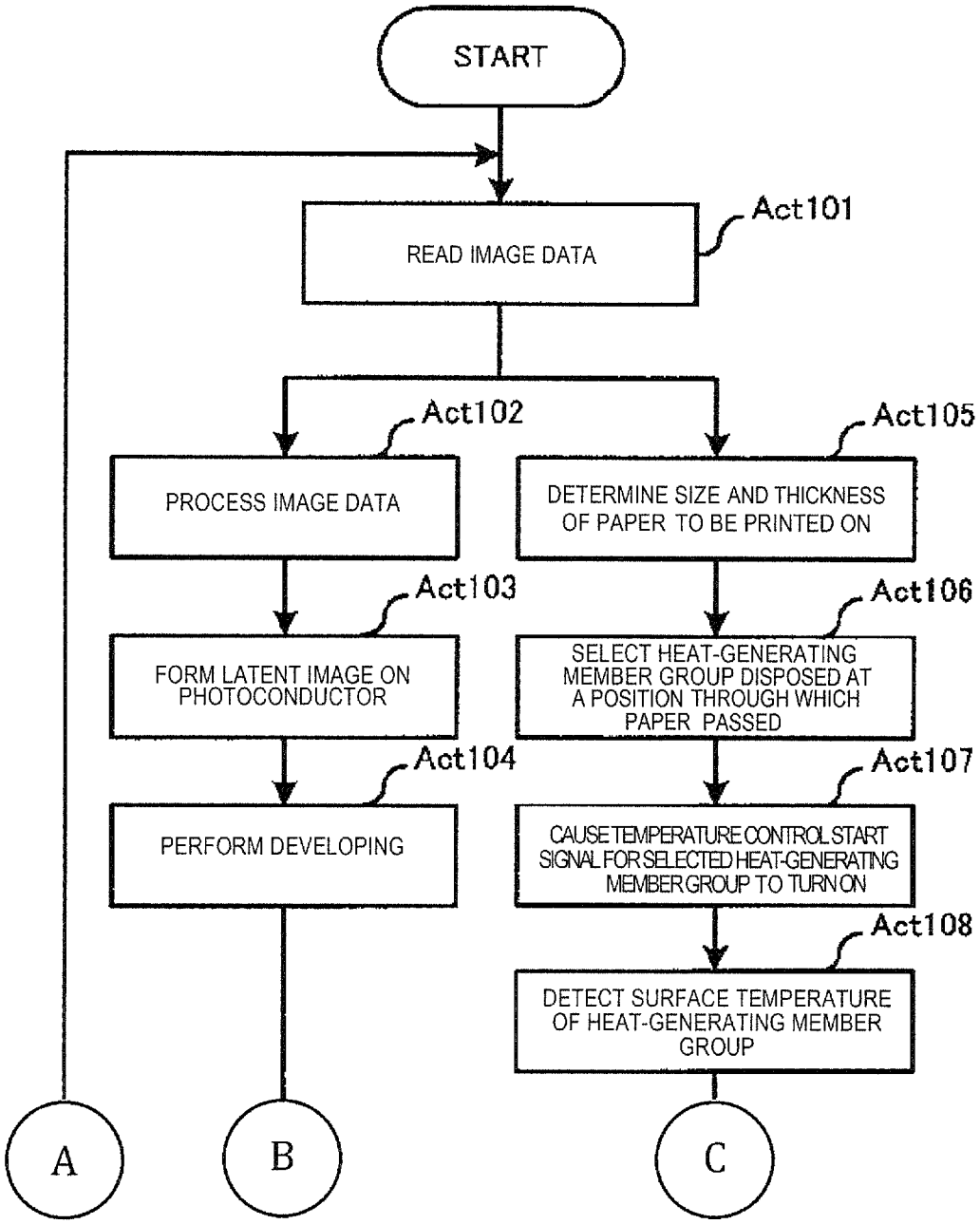
FIGS. 8A-8C are flowcharts illustrating a specific example of a control operation of the MFP in the embodiment.
Figure 8B:
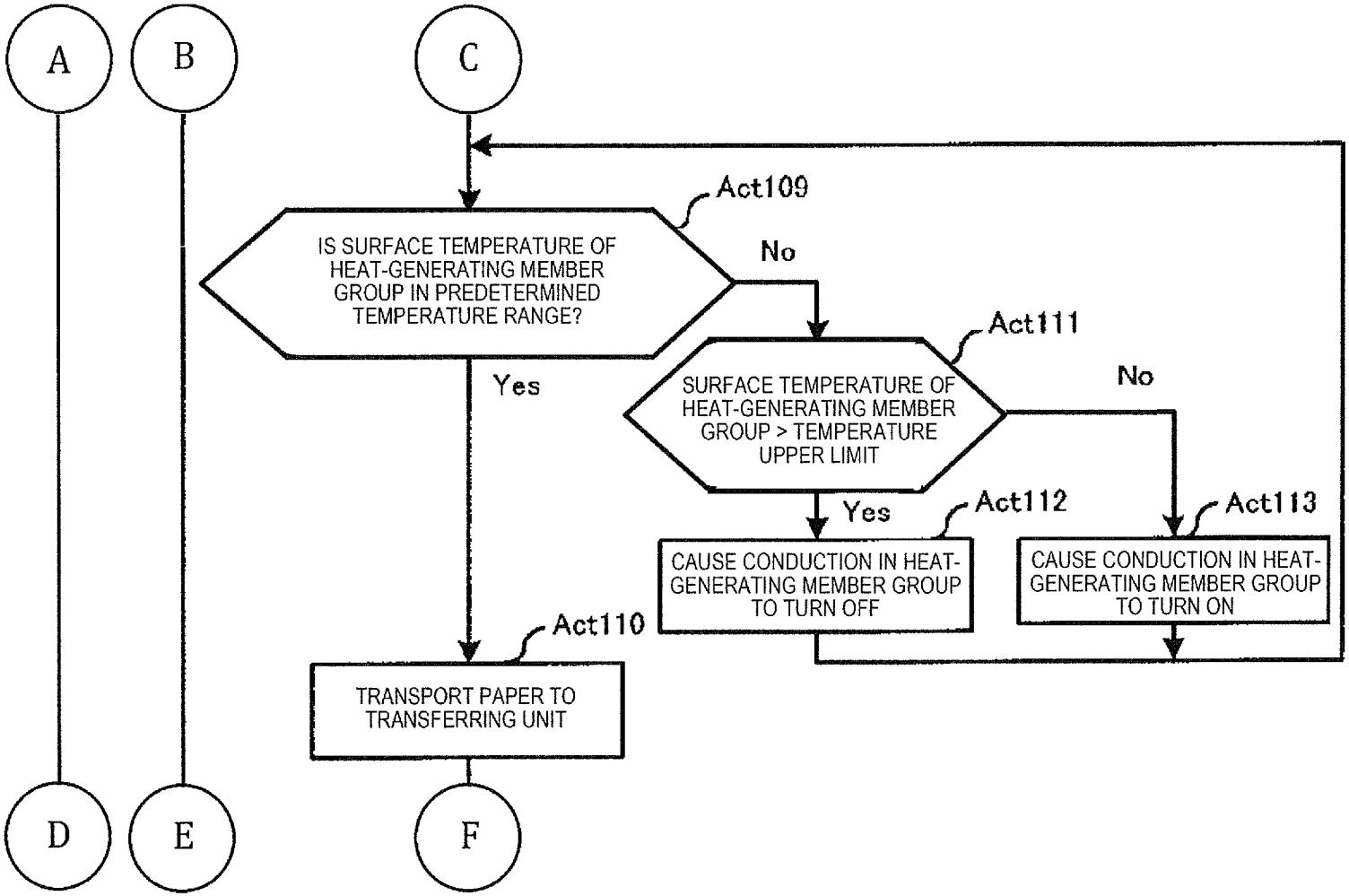
Figure 8C:
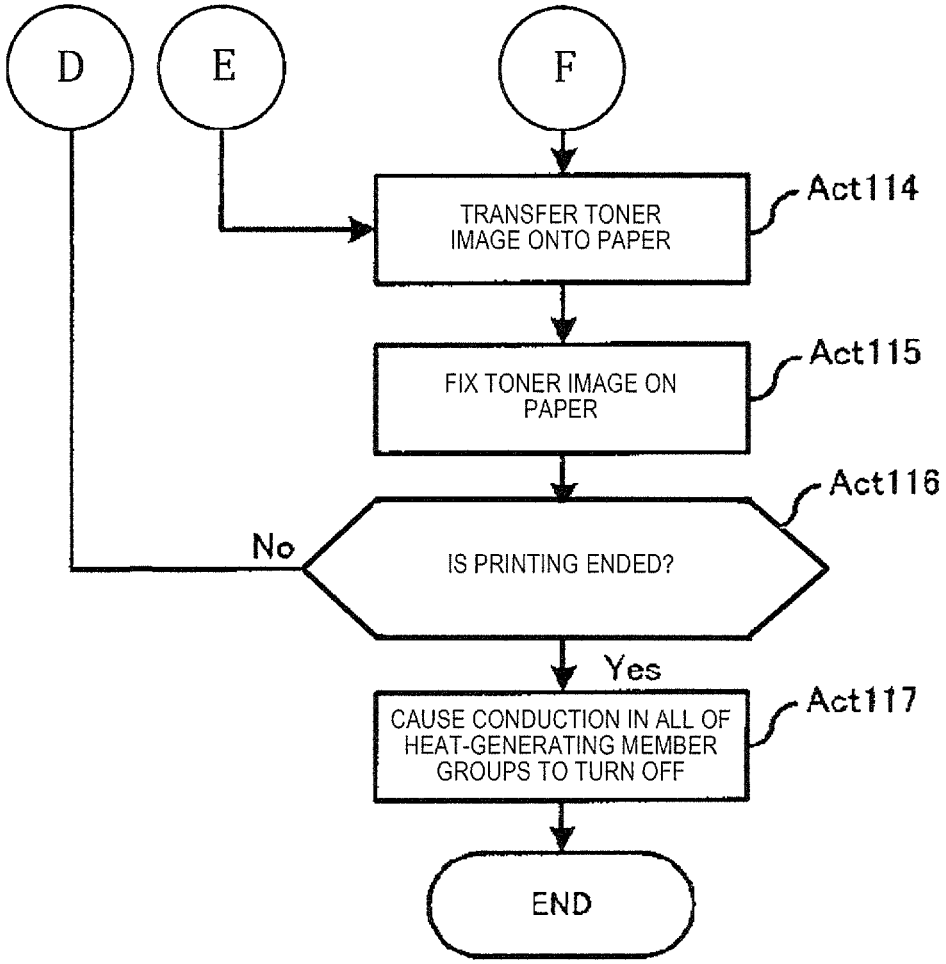

An operation of the MFP 10 having the above-described configuration when printing is performed will be described below based on the drawings. FIG. 8 is a flowchart illustrating a specific example of control of the MFP 10 in Embodiment 1.

First, if the scanner unit 15 reads image data (Act101), an image forming control program in the image forming unit 20 and the fixing temperature control program in the fixing device 36 are executed in parallel.

If image forming processing is started, the read image data is processed (Act 102) and an electrostatic latent image is formed on the surface of the photoconductive drum 22 (Act 103). The developing device 24 develops the electrostatic latent image (Act 104), and then the process proceeds to Act 114.

Figure 9:
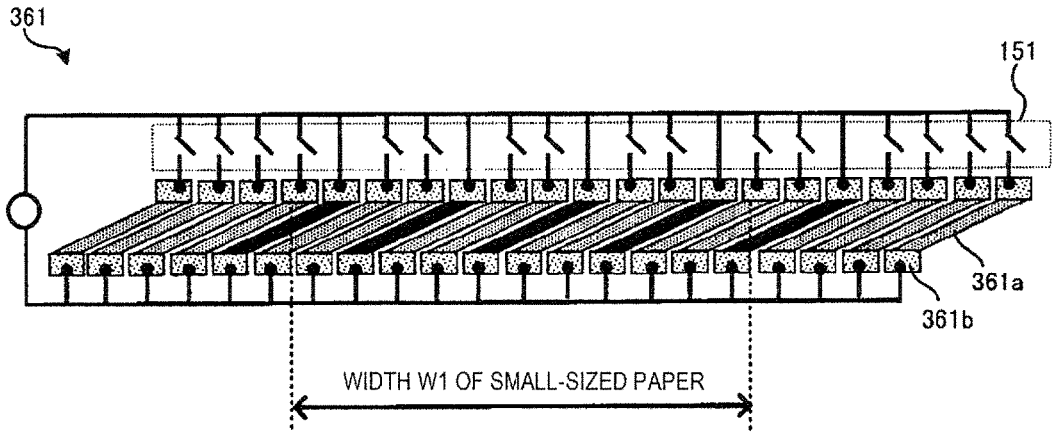
FIG. 9 is a diagram illustrating a connection state of the heat-generating member groups and the driving circuits thereof in the embodiment.
Figure 10:
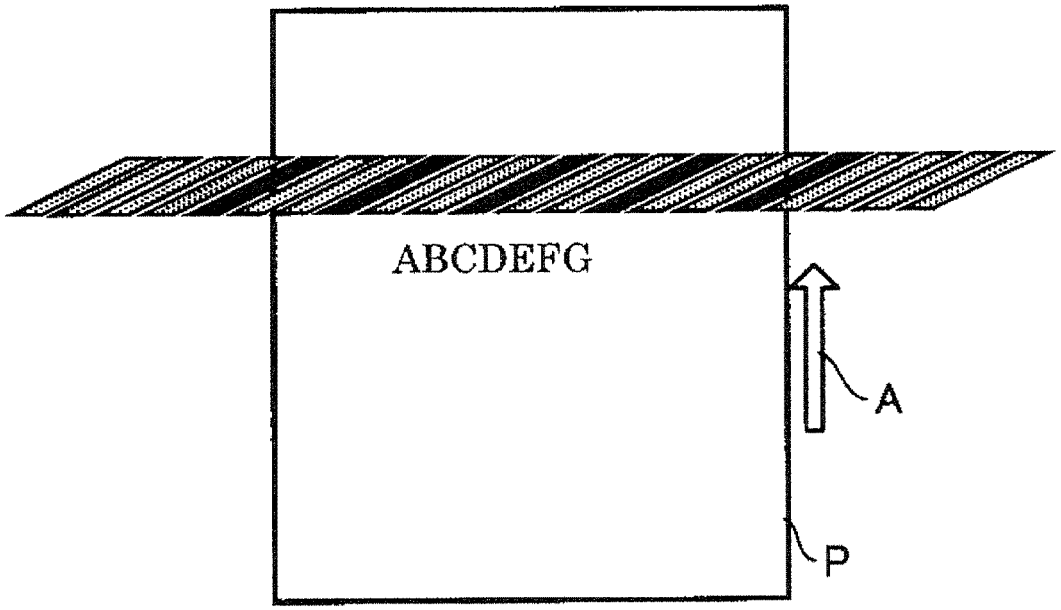
FIG. 10 is a diagram illustrating a form of paper passing through the heat-generating member group in the embodiment.

If fixing temperature control processing is started, a paper size and the thickness are determined based on a detection signal of the line sensor (not illustrated) which is disposed in the transport path or paper selection information by the operation panel 14, for example (Act 105), and the heat-generating member group which is disposed at a position through which the paper P passes is selected as a heating target (Act 106). For example, as illustrated in FIG. 7, 13 heat-generating members 361*a* which are disposed at the center so as to correspond to a horizontal width of the paper P are selected. Meanwhile, even though the paper P is the same size as that in a case of FIG. 7, the thickness of the paper is thin and it is considered that a temperature rising speed is faster than that of general paper, and conduction targets are selected so as to be reduced to ⅓, as illustrated in FIG. 9. Similarly, the basis weight of paper, a surface temperature of the heat-generating member, a value of the outdoor air temperature, and the like which are detected by sensors may be used as a determination component for selecting a conduction target, in addition to the thickness of the paper. FIG. 10 is a diagram illustrating a form of the paper P passing through the heat-generating member group. FIG. 10 illustrates that the time taken to heat the same area becomes short in order to reduce the number of the conduction targets, but the paper P is heated by any one of the heat-generating members in the middle of being transported.

If a temperature control start signal for the selected heat-generating member group turns ON (Act 107), the selected heat-generating member group is conducted and the temperature of the conducted heat-generating member group is increased.

If the temperature sensing member (not illustrated) which is disposed on the inside or the outside of the endless belt 363 detects the surface temperature of the heat-generating member group (Act 108), it is determined whether or not the surface temperature of the heat-generating member group is in a predetermined temperature range (Act 109). When it is determined that the surface temperature of the heat-generating member group is in a predetermined temperature range (Yes in Act 109), the process proceeds to Act 110. On the other hand, when it is determined that the surface temperature of the heat-generating member group is not in a predetermined temperature range (No in Act 109), the process proceeds to Act 111.

In Act 111, it is determined whether or not the surface temperature of the heat-generating member group exceeds a predetermined temperature upper limit value. When it is determined that the surface temperature of the heat-generating member group exceeds a predetermined temperature upper limit value (Yes in Act 111), a conduction state of the heat-generating member group selected in Act 106 turns OFF (Act 112) and the process returns to Act 108. On the other hand, when it is determined that the surface temperature of the heat-generating member group does not exceed a predetermined temperature upper limit value (No in Act 111), it means a state where the surface temperature does not reach a predetermined temperature lower limit value by a determination result in Act 109, and thus the heat-generating member group maintains the conduction state of ON or turns ON again (Act 113). The process returns to Act 108. A proportion of ON and OFF in Acts 112 and 113 may be appropriately changed in accordance with a difference between the surface temperature and a fixing temperature of the heat-generating member group in order to adjust the temperature rising speed and a temperature falling speed.

If the paper P is transported to a transferring unit in a state where the surface temperature of the heat-generating member group is in the predetermined temperature range (Act 110), a toner image is transferred on the paper P (Act 114), and then the paper P is transported into the fixing device 36.

If the toner image is fixed on the paper P in the fixing device 36 (Act 115), it is determined whether or not printing processing of image data is ended (Act 116). When it is determined that the printing processing is ended (Yes in Act 116), the conduction state of all of the heat-generating member groups turns OFF (Act 117), and the process is ended. On the other hand, when it is determined that the printing processing of the image data is not ended (No in Act 116), that is, when image data to be printed remains, the process returns to Act 101 and similar processing is repeated until the process is ended.

In this manner, in the fixing device 36 according to this embodiment, each of the heat-generating members which constitute the heating member 361 is inclined from the paper transport direction to a predetermined angle direction and is formed to have the same length. The heat-generating members are disposed to come into contact with the inside of the endless belt 363 and the heat-generating member group through which the paper passes is selectively conducted. A heat-generating area is switched based on the paper size, and thus it is possible to prevent abnormal heat generation at a non-passing portion and to suppress useless heating at the non-passing portion. Thus, it is possible to greatly reduce thermal energy consumed by the fixing device 36. A printing portion is enabled to be stably heated in a concentrated manner and thus it is possible to improve fixation quality. The image area of the paper passes through the plurality of the heat-generating members while straddling the plurality of the heat-generating members, depending on an inclination shape of the heat-generating members. Even though a proportion of the heat-generating members to be conducted is reduced based on the thickness of the paper and the like, since the image area of the paper is heated by the conducted heat-generating members, temperature ripple due to ON and OFF control does not occur and heating control with multi-stages is enabled. Particularly, this is effective in switching performed when printing is sequentially performed on pieces of paper which have different sizes or thicknesses.

In the above-described embodiment, a case where the non-passing portion is completely non-heated is described. However, the heat-generating object at the non-passing portion may be conducted in a necessary range, in order to rapidly handle pieces of paper having mixed sizes. In this case, there is no heat flow at the non-passing portion and thus it is very effective for preventing abnormal heat generation. Further, in the above-described embodiment, the heat-generating member which is at a passing position based on the paper size is conducted. However, modification in which the heat-generating members corresponding to the image forming area of the paper are conducted may be made.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fixing device comprising:

an endless rotating body;

a plurality of heat-generating resistors that heats a medium, each heat-generating resistor being parallelogram pattern and being parallel, formed in a perpendicular direction to a transporting direction of the medium, inclined from the transporting direction to a direction of a predetermined angle, and divided by a predetermined length, and being disposed so as to come into contact with an inner side of the endless rotating body;

a plurality of switches, each of the switch being connected to each heat-generating resistor, that switch individual conduction of these switches connected to heat-generating resistors corresponding to a position through which the medium passes, the plurality of heat-generating resistors being able to be thinned out by controlling of each of the switch; and a pressing roller that forms a nip by performing pressing and contact at a position of the plurality of heat-generating resistors, and for nipping and carrying the medium in the transporting direction.

2. The device according to claim 1, wherein the plurality of heat-generating resistors are formed to have the same size, and bottom portions of the plurality of heat-generating resistors are arranged on the same line.

3. The device according to claim 2, wherein the plurality of heat-generating resistors are formed to have resistance values which are changed at a certain ratio.

4. The device according to claim 1, wherein the plurality of heat-generating resistors are formed to have resistance values which are changed at a certain ratio.

5. A printing device comprising:

an endless belt;

a plurality of heat-generating resistors that heat a medium, each heat-generating resistor being parallelogram pattern and being parallel, formed in a perpendicular direction to a transporting direction of the medium, inclined from the transporting direction to a direction of a predetermined angle, and divided by a predetermined length, and being disposed so as to come into contact with an inner side of the endless belt;

a plurality of switches, each of the switches being connected to each heat-generating resistor, that switch individual conduction of these switches connected to heat-generating resistors corresponding to a position through which the medium passes;

a pressing roller that forms a nip by performing pressing and contact at a position of the plurality of heat-generating resistors, and for nipping and carrying the medium in the transporting direction; and a controller that determines the size of a medium on which a toner image is formed, the controller that controls for the plurality of switches connected to the plurality of heat-generating resistors, the plurality of heat-generating resistors being able to be thinned out by the controller that controls each of the switch.

6. The printing device according to claim 5, wherein the controller determines the size of the medium and a thickness or basis weight of the medium, and the controller controls the plurality of switches to select heat-generating resistors which are not to be conducted, among the heat-generating resistors corresponding to the position through which the medium passes based on a result of the determination and suppresses heating of the heat-generating resistors.

7. The printing device according to claim 5, wherein the plurality of heat-generation resistors are formed to have the same size, and bottom portions of the plurality of heat-generating resistors are arranged on the same line.

8. The printing device according to claim 7, wherein the plurality of heat-generation resistors are formed to have resistance values which are changed at a certain ratio.

9. The printing device according to claim 5, wherein the controller determines the size of the medium and a surface temperature of the heat-generating resistor, and the controller controls the plurality of switches to select heat-generating resistors which are not to be conducted, among the heat-generating resistors corresponding to the position through which the medium passes based on a result of the determination and suppresses heating of the heat-generating resistors.

10. The printing device according to claim 9, wherein the plurality of heat-generating resistors are formed to have the same size, and bottom portions of the plurality of heat-generating resistors are arranged on the same line.

11. The printing device according to claim 10, wherein the plurality of heat-generating resistors are formed to have resistance values which are changed at a certain ratio.

12. The printing device according to claim 5, wherein the controller determines the size of the medium and a value of the outdoor air temperature, and the controller controls the plurality of switches to select heat-generating resistors which are not to be conducted, among the heat-generating resistors corresponding to the position through which the medium passes based on a result of the determination and suppresses heating of the heat-generating resistors.

13. The printing device according to claim 12, wherein the plurality of heat-generating resistors are formed to have the same size, and bottom portions of the plurality of heat-generating resistors are arranged on the same line.

14. The printing device according to claim 13, wherein the plurality of heat-generating resistors are formed to have resistance values which are changed at a certain ratio.

15. A fixing temperature control method of a fixing device which includes a plurality of heat-generating resistors, a plurality of switches, and a pressing roller and fixes a toner image on the medium by heating a plurality of heat-generating resistors that heat a medium, each heat-generating resistor being parallelogram pattern and being formed in a perpendicular direction to a transporting direction of the medium, being inclined from the transporting direction to a direction of a predetermined angle, and being divided by a predetermined length, individually switching conduction of these heat-generating resistors, the plurality of switch, each of the switches being connected to each heat-generation resistor, the plurality of heat-generating resistors being able to be thinned out by controlling each of the switch, the method comprising:

determining the size of the medium; and controlling the plurality of switch to select and conduct these switches connected to heat-generating resistors corresponding to a position through which the medium passes, among the plurality of heat-generating resistors and controlling heating of the heat-generating resistors.

16. The fixing temperature control method according to claim 15 further comprising:

determining the size of the medium and a thickness or basis weight of the medium, and controlling the plurality of switches to select heat-generating resistors which are not to be conducted, among the heat-generating resistors corresponding to the position through which the medium passes based on a result of the determination and suppresses heating of the heat-generating resistors.

17. The fixing temperature control method according to claim 15 further comprising:

determining the size of the medium and a surface temperature of the heat-generating resistor, and controlling the plurality of switches to select heat-generating resistors which are not to be conducted, among the heat-generating resistors corresponding to the position through which the medium passes based on a result of the determination and suppresses heating of the heat-generating resistors.

18. The fixing temperature control method according to claim 15 further comprising:

the controller determines the size of the medium and a value of the outdoor air temperature, and the controller controls the plurality of switches to select heat-generating resistors which are not to be conducted, among the heat-generating resistors corresponding to the position through which medium passes based on a result of the determination and suppresses heating.

* * * * *